US008850935B2

(12) United States Patent
Kuo et al.

(10) Patent No.: US 8,850,935 B2
(45) Date of Patent: Oct. 7, 2014

(54) HAND TOOL

(71) Applicants: Yu-Ching Kuo, Taichung (TW); Yi-Ching Yu, Taichung (TW)

(72) Inventors: Yu-Ching Kuo, Taichung (TW); Yi-Ching Yu, Taichung (TW)

( * ) Notice: Subject to any disclaimer, the term of this patent is extended or adjusted under 35 U.S.C. 154(b) by 203 days.

(21) Appl. No.: 13/633,894

(22) Filed: Oct. 3, 2012

(65) Prior Publication Data

US 2013/0319189 A1 Dec. 5, 2013

(30) Foreign Application Priority Data

Jun. 1, 2012 (TW) ..... 101210546 U

(51) Int. Cl.
*B25B 23/16* (2006.01)
*B25B 15/00* (2006.01)
*B25G 1/10* (2006.01)

(52) U.S. Cl.
USPC ..... 81/460; 81/489; 81/121.1

(58) Field of Classification Search
USPC ..... 81/121.1, 125.1, 177.1, 177.2, 460, 81/489, 52, 58; 16/430
See application file for complete search history.

(56) References Cited

U.S. PATENT DOCUMENTS

| | | | | |
|---|---|---|---|---|
| 5,730,662 | A * | 3/1998 | Rens | 473/300 |
| 6,332,379 | B1 * | 12/2001 | Klomp | 81/60 |
| 2005/0193876 | A1 * | 9/2005 | Broyles | 81/489 |
| 2011/0048177 | A1 * | 3/2011 | Lin | 81/58 |

* cited by examiner

*Primary Examiner* — David B Thomas
(74) *Attorney, Agent, or Firm* — Cheng-Ju Chiang

(57) ABSTRACT

A hand tool includes a shaft, at least one affecting portion, and a protection layer. The shaft is like a bar, and can be hold by a hand. The affecting portion connects with the shaft. The affecting portion can grip a specific part which a user wants to control. The protection layer is settled and/or covered on at least one portion of the hand tool surface. The protection layer is lumpy and rough. Because of the protection layer, the hand tool is shake-proof, wear-proof, slip-resistance, and electric insulation.

8 Claims, 6 Drawing Sheets

HAND TOOL

BACKGROUND OF THE INVENTION

1. Field of the Invention

The present invention is related to a kind of a hand tool, more particularly to the kind of a hand tool with shake-proof, wear-proof, slip-resistance and electric insulation.

2. Description of the Related Art

Human beings can survive in nature without an ideal physical condition—even to create the civilization and diversified technologies by the time—this evolvement is not only because of the well-developed brains, also the good utilization of tools. The tools used by human beings have been developed more and more delicate with time, from knapped stone tools, to hand tool shaped variously and preciously for utilizing purposes.

Namely, the hand tool is hold by hands to accomplish some certain objectives with different ways of applying force. Due to this character, hand tool needs an area designed for a hand to hold and to apply the force. Using the hand tool, a hand must touch to the hard part of the holding area directly. The reaction and shake generated from the hand tool is transmitted to the hand and could cause soreness, numbness and injury of the hand. If the hand tool is hold for long time, sweat can make the slippery of the hand and further cause the inconvenience of applying the force and the danger of falling off.

For operating numerous parts, affecting portion of hand tool must grip with the parts to shape diversely; moreover, the shape of hand tool could be changed in comply with the position of the parts. For example, for driving nails the at least one top of a hammer should be flat; for gripping screw heads of six-sided recess, the head of Allen wrench is hexagon-shaped; for working in confined space or providing more force, the L wrench is shaped like "L". For easier to use and to apply force, the forms of the hand tool are irregular with endpoint, protrusion, dent, turning point, and/or the combination thereof Therefore, in accordance with the need of use, different portions of the hand tool might be assembled. For assembling that together, we use a locking part; the locking part means for connecting the different portions of the hand tool. The endpoint, protrusion, dent, turning point can be worn easily and the locking part can be loose by the applied force repeatedly. These aforementioned drawbacks have not been improved of the conventional hand tool. The hand tool is worn easily with direct touch of parts. The users are unaware of the looseness of the locking part after the employ of the hand tool with time. Consequently, the users could be hurt by the exposed sharp end caused by accidental slipping away, falling off, or looseness of the hand tool.

Electroplating can be adopted for avoiding the surface of the conventional hand tool being corroded or worn. However, Electroplating needs a lot of energy and also produces heavy pollution from the intermediates in the process. Moreover, the electroplating sewage is a serious problem. Discharging sewage without proper process will cause devastating heavy metal pollution.

The hand tool made by metals is also a good conductor of electricity. If the lack of protection to an electric current is remained, in certain particular environment such as practicing some electric projects, it is easy to get an electric shock and even causes the death for a technician.

As described disclosure we can learn that the design of the conventional hand tool could cause inconvenience of applying the force by the users. The design could also cause slipping away easily, being corroded easily, the touching injury by falling off or slipping away of the hand tool, poor ability of absorbing shake, the looseness of the locking parts, the electric shock and environmental pollution. On account of above drawbacks, the present invention provides a kind of hand tool. The special design of the present invention can solve the drawbacks in the conventional prior art.

SUMMARY OF THE INVENTION

The present invention of the hand tool comprises a shaft, at least one affecting portion and a protection layer. The shaft is shaped like a bar for a user to hold and to apply force. The at least one affecting portion is connected with the shaft. The shape of the at least one affecting portion can be changed to grip a special part firmly; therefore, the shape of the at least one affecting portion can be in accord with the shape of the special part and the user's force can transmit through the shaft to the special part. The protection layer is settled and/or covered on at least one portion of the surface of the hand tool.

The material of the protection layer comprising Polyolefin; therefore, the material is also an elastic material and possessing contractibility. This makes the protection layer is able to contract, fit and cover the at least one portion of the surface of the irregularly shaped hand tool tightly. The protection layer can be settled and/or covered on the surface of the irregular shape; therefore, the irregular shape of the settled and/or covered protection layer comprises a columnar shape, a pyramidal shape, a spindle shape, a dumbbell-shape or the combination thereof The shaft, the at least one at least one affecting portion, the endpoint, the protrusion, the dent, the turning point, and/or the shape of combination thereof of the hand tool can be settled and/or covered by the protection layer.

An Exterior of the protection layer has a design. The design is formed by a plurality of interlaced embossment and depression. The surface of the plurality of embossment and depression are different extents of roughness.

The material of the protection layer is soft and insulated. When it is settled and/or covered on the surface of the shaft, shake and reaction can be absorbed by the protection layer during the employment of the hand tool. The protection layer is resistant conducting an electric current form the shaft to a human body. The external design of the protection layer has interlaced embossment and depression to increase friction while users holding hand tool to avoid slipping away or the inconvenience of applying the force. Both the settlement with the non-slip decorative pattern on the surface of the embossment and depression plus the different extents of the roughness of the embossment and depression further reinforce the friction.

When the shaft, at least one affecting portion, the endpoint, the protrusion, the dent, the turning point, and other sharpen or non-smooth area are settled and/or covered by the protection layer, the material of the hand tool is not touched with other objects directly. This can reduce the possibility of corroding. The protection layer also covers the hand tool tightly; therefore, it can prevent the locking part of the hand tool from loosing. Even if the hand tool is falling off or slipping away, the sharp end does not touch the human body directly because of the insulation of the protection layer. Despite the portions of the hand tool out of order which are covered by the protection layer, we only need to remove the elastic protection layer temporarily to fix it.

The coverage of the protection layer on the large portion of the hand tool can replace the general electroplating process. The consumption of the energy can be reduced and the sewage containing heavy metal is not a problem in the manufacturing process.

The color or the design of the protection layer could be changed depending on the need. This makes the user much easier to recognize or makes the hand tool more beautiful. For example, the color of the hand tool could be changed based on purposes or the environment during using the hand tool; for example, the color of the protection layer could be changed with the different sizes of the hand tool in red, yellow or blue.

DETAILED DESCRIPTION OF THE INVENTION

Figure 1:
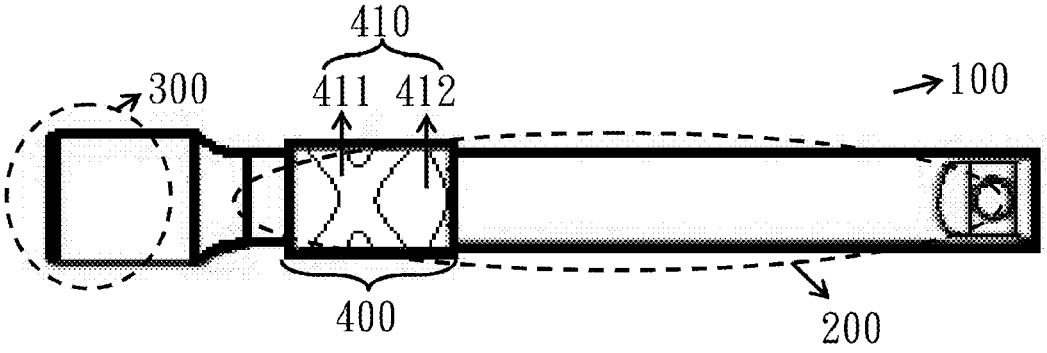
FIG. 1 illustrates a top view of the first embodiment in the present invention.

The thorough disclosure of the present invention is in accord with the drawings. Referring to first embodiment in FIG. 1, a hand tool 100 comprises shaft 200, at least one affecting portion 300, and a protection layer 400. An exterior of the protection layer 400 further comprises a design 410. The design 410 is formed by a plurality of interlaced embossment 411 and depression 412. In the FIG. 1, the protection layer 400 is settled and/or covered on the surface of the shaft 200 and closed to the at least one affecting portion 300. A Shape settled and/or covered area by the protection layer 400 is a columnar shape. The area where the protection layer 400 settled and/or covered is a place where a hand of a user holds the shaft 200. When using the hand tool 100 as shown in the FIG. 1, reaction and shake can be absorbed by the protection layer 400 and the friction while holding can be also raised. The protection layer 400 provides functions of shake-proof and slip-resistance.

Figure 2A:
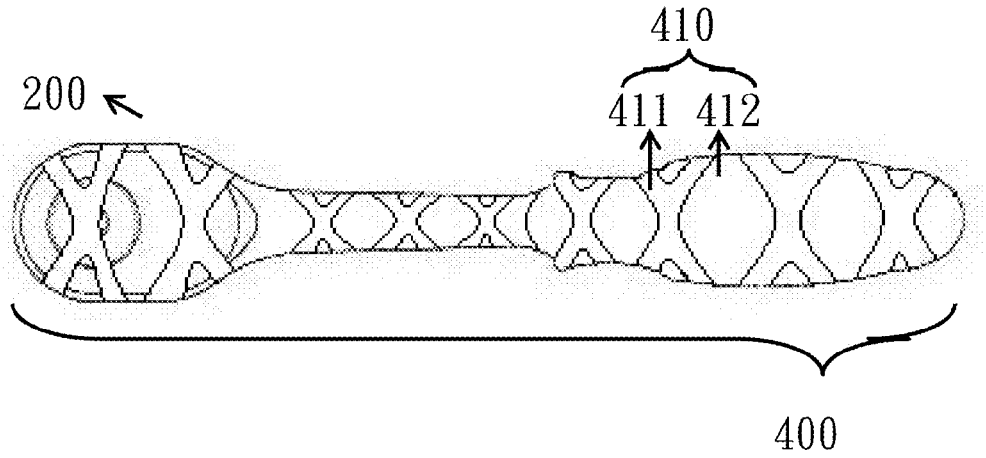
FIG. 2A illustrates a top view of the second embodiment of the protection layer settled and/or covered on the shaft.
Figure 2B:
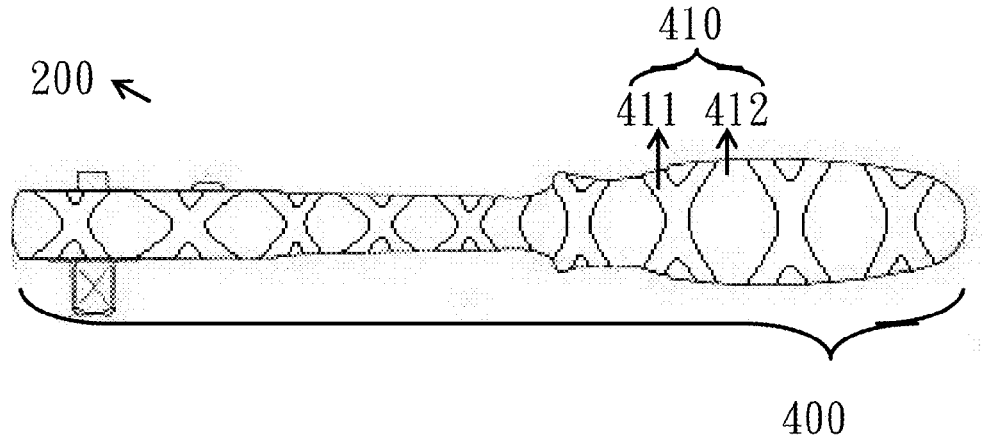
FIG. 2B illustrates a side view of the second embodiment of the protection layer settled and/or covered on the shaft in the present invention.

Both FIG. 2A and FIG. 2B illustrate the drawings of the second embodiment of the shaft 200 in the present invention. The other end of the shaft 200 without being hold by the hand can be connected with the at least one affecting portion 300 as shown in FIG. 3A, FIG. 3B, FIG. 4A, FIG. 4B, FIG. 5A, FIG. 5B. In the FIG. 2A and FIG. 2B, the protection layer 400 is settled and/or covered whole surface of the shaft 200, comprising the area where a palm touches and the front-end area of the shaft 200 where the at least one affecting portion 300 prepares for being connected. The whole settled and/or covered area shapes as a columnar shape. The protection layer 400 also provides the function of absorbing shake, slip-resistance and also avoids soreness, numbness of palm, the hand-touched area wet and slippery, and corroding of the shaft 200. The protection layer 400 is settled and/or covered locking parts of the front-end of the shaft 200, and also avoids looseness of the locking part.

A firm portion of the hand tool 100 is not touched by the hand because the protection layer 400 in the present invention is settled and/or covered on the surface of the shaft 200. When the reaction and the shake are transmitted back to the shaft 200, through softness of the protection layer 400, part of the reaction and the shake are absorbed by the protection layer 400 and they are not about to affect the user. The design 410 comprising the embossment 411 and the depression 412 on the exterior of the protection layer 400 reinforces the friction while holding. Above the mentioned advantages, the present invention prevents the user's injury from shaking and slipping, and makes the user much easier to use.

Figure 3A:
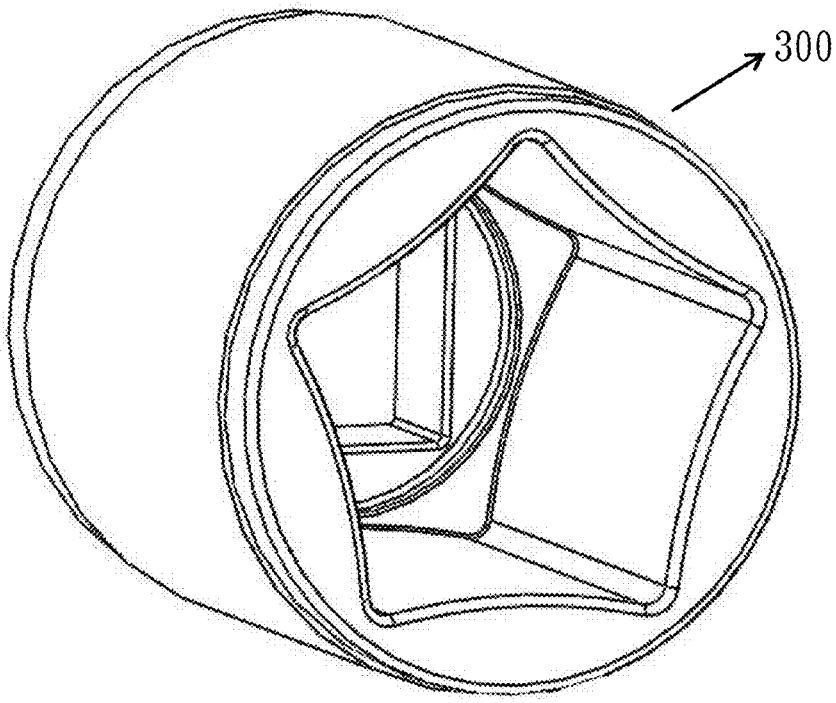
FIG. 3A illustrates a side view of the socketed torx shape of the at least one affecting portion in the present invention.
Figure 3B:
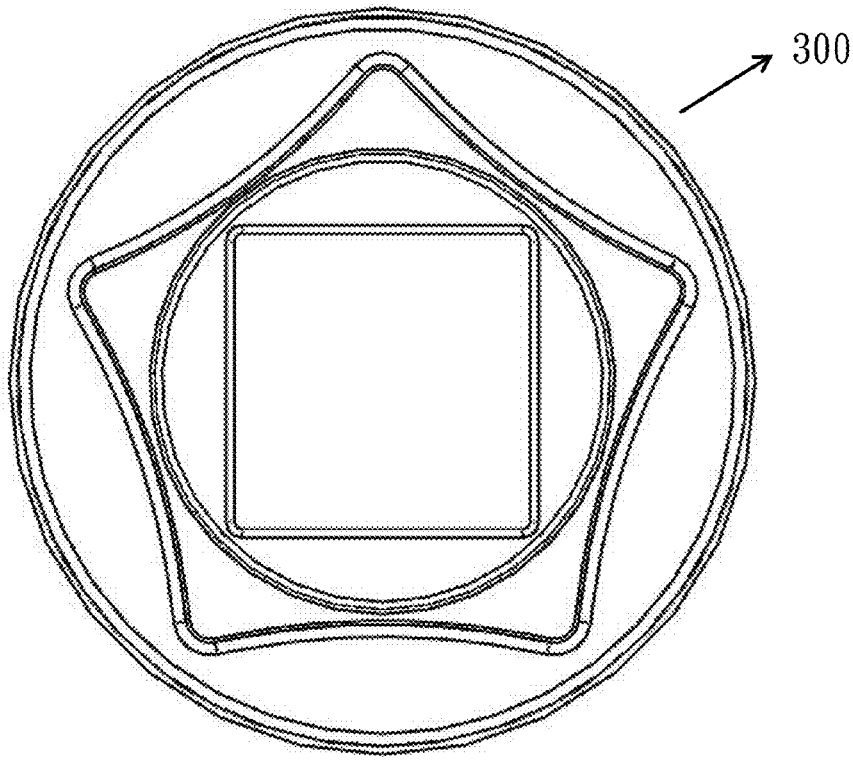
FIG. 3B illustrates a front view of the socketed torx shape of the at least one affecting portion in the present invention.
Figure 4A:
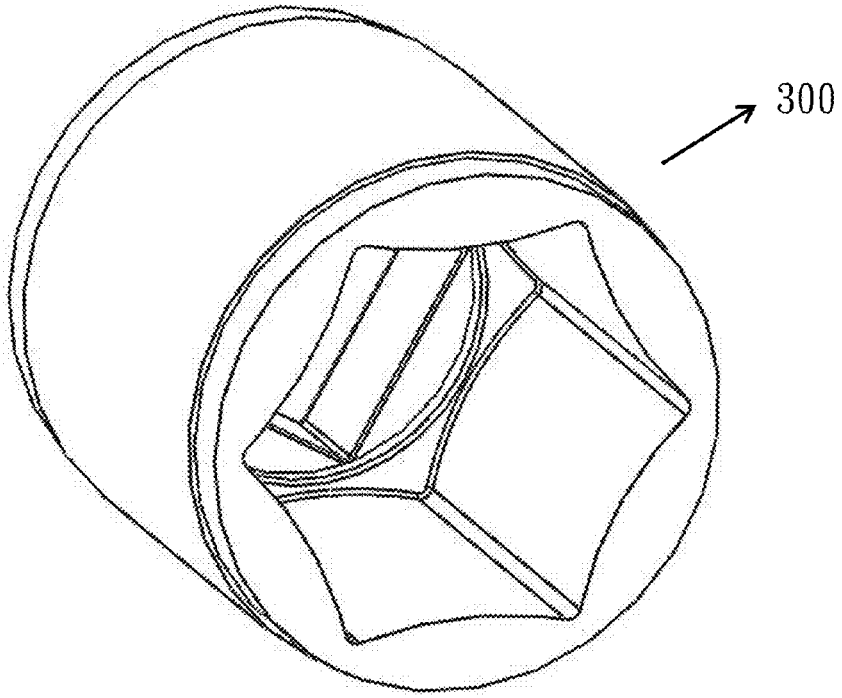
FIG. 4A illustrates a side view of the socketed hex-head shape of the at least one affecting portion in the present invention.
Figure 4B:
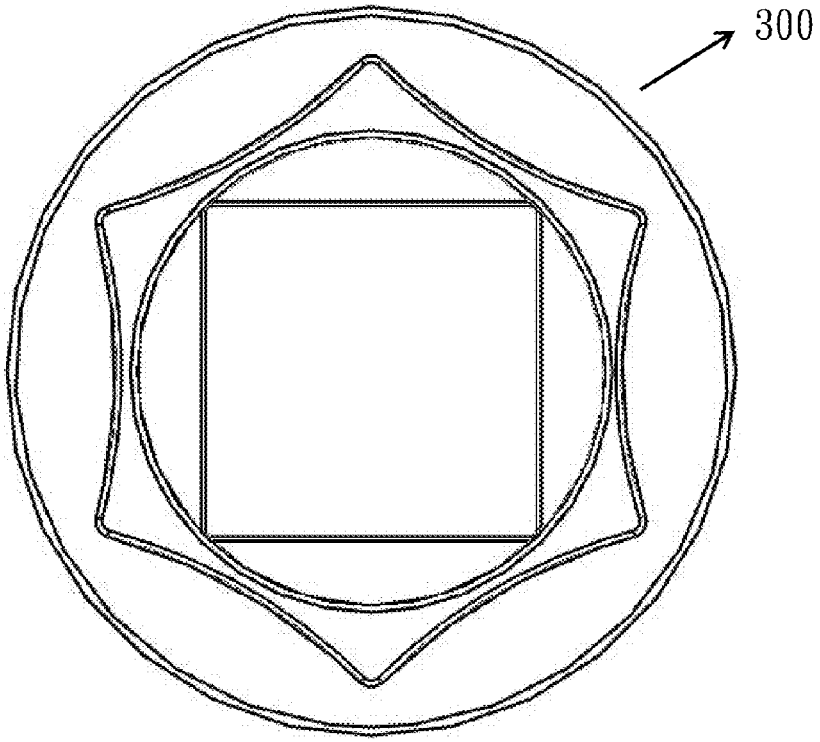
FIG. 4B illustrates a front view of the socketed hex-head shape of the at least one affecting portion in the present invention.
Figure 5A:
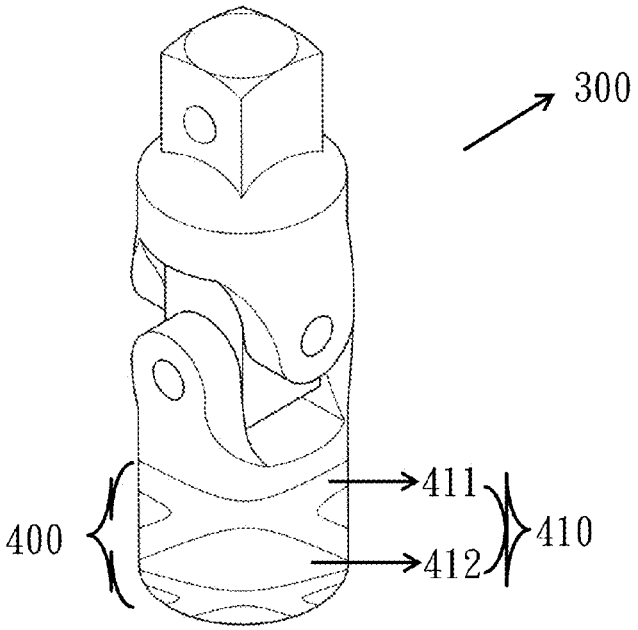
FIG. 5A illustrates a para-side view of turnable at least one affecting portion in the present invention.
Figure 5B:
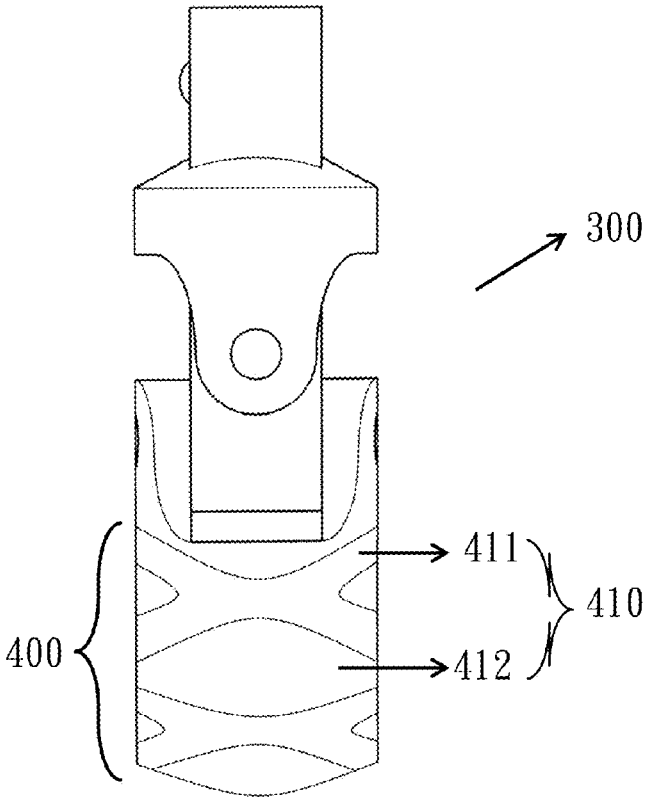
FIG. 5B illustrates another side view of the turnable at least one affecting portion in the present invention.

The at least one affecting portion 300 in the present invention can grip a specific part. The shape comprises protruded slotted-head, Philips, square-head, torx, hex-head and socketed square, torx, hex-head, 12-point, and other protruded and socketed shapes for gripping the specific part. The specific part can be a slotted-head screw, a Philips screw, a square-head screw, a torx screw, a hex-head screw, a square-head bolt, a torx bolt, a hex-head bolt, a nail, a rivet. FIG. 3A and FIG. 3B illustrate another embodiment of the at least one affecting portion 300. The specific part for being gripped is the torx bolt. In the FIG. 3A and FIG. 3B, the shape of the at least one affecting portion 300 is the socketed torx shape. FIG. 4A and FIG. 4B illustrate another embodiment of the at least one affecting portion 300. The specific part for being gripped is the hex-head bolt. In the FIG. 4A and FIG. 4B, the shape of the at least one affecting portion 300 is the socketed hex-head shape. FIG. 5A and FIG. 5B illustrate turnable at least one affecting portion 300, another embodiment of the at least one affecting portion 300. Being connected to the shaft 200, the at least one affecting portion 300 can be turned to different directions depending on the need of the user. As shown in FIG. 5A and FIG. 5B, the protection layer 400 is settled and/or covered on the at least one affecting portion 300, to avoid corroding and injury.

Figure 6:
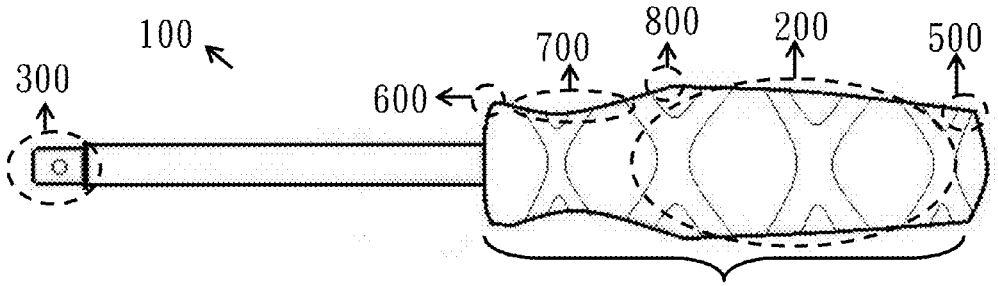
FIG. 6 illustrates a top view of the third embodiment in the present invention in the present invention.

FIG. 6 illustrates the top view of the third embodiment in the present invention. An end point 500, a protrusion 600, a dent 700, and a turning point 800 are disposed on the hand tool 100. The protection layer 400 is settled and/or covered on these irregular areas to avoid the material of the hand tool 100 directly touching with other objects and then being corroded. The protection layer 400 can also prevent the user's injury from sharp end caused by the hand tool 100 slipping away or falling off.

Figure 7:
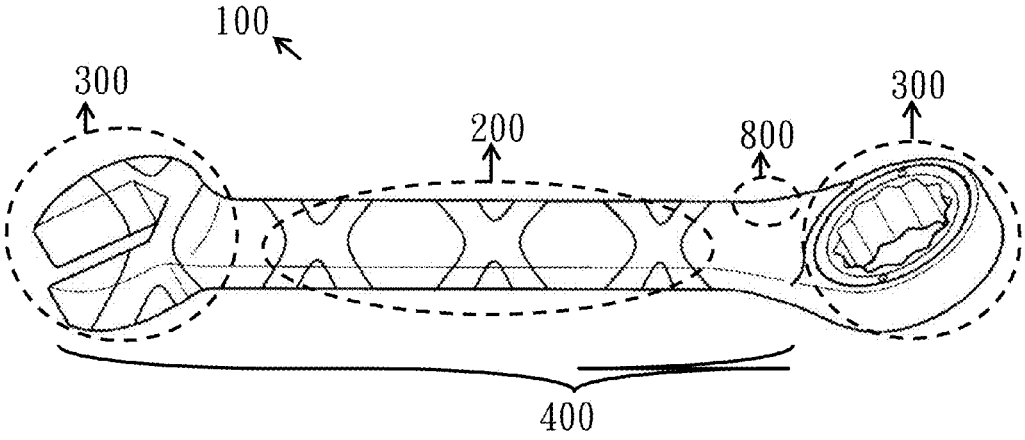
FIG. 7 illustrates a top view of the fourth embodiment in the present invention in the present invention.

The drawing of FIG. 7 is the top view of the fourth embodiment in the present invention. The main difference in this embodiment is that the two affecting portions 300 are disposed. One of the affecting portions 300 has shaper edges and the protection layer 400 is settled and/or covered the shaper edges to avoid the problems of corroding, injuries by falling off or slipping away from the hand tool 100. The material of the protection layer 400 possesses the characteristic of insulation. The resistance of the protection layer 400 is larger than ordinary objects; therefore, the protection layer 400 settled and/or covered on the at least one affecting portion 300 and the shaft 200 prevents an electric shock, and further raises the safety while working.

The described embodiments and following drawings are merely illustrative and should not be considered restrictively in any way.

According to the aforementioned description, the present invention is able to solve the drawbacks of the inconvenience of applying the force; the poor ability of absorbing shake, being corroded easily, slipping away easily, the touching injury caused by falling off or slipping away, the looseness of the locking part, the electric shock, and the environmental pollution. It is a creative design filled with practical applications.

What is claimed is:

1. A hand tool comprises:

a shaft shaped like a bar for a user to hold and to apply force;

at least one affecting portion connected with the shaft for gripping a specific part, and the applied force transmitting from the shaft to the specific part; and a protection layer settled and/or covered on at least one portion of a surface of the hand tool, wherein a material of the protection layer comprises Polyolefin, the material being an elastic material and possessing contractibility, wherein the protection layer is able to contract, fit and cover the at least one portion of the surface of the hand tool tightly, wherein an exterior of the protection layer comprises a design formed by a plurality of interlaced embossment and depression, wherein a surface of the plurality of the embossment and the depression are different extents of roughness.

2. The hand tool as claimed in claim 1, wherein a shape of the at least one affecting portion comprises protruded slotted-head, Philips, square-head, torx, hex-head, and other protruded shapes for gripping the specific part.

3. The hand tool as claimed in claim 1, wherein the shape of the at least one affecting portion comprises socketed square-head, torx, hex-head, 12-point, and other socketed shapes for gripping the specific part.

4. The hand tool as claimed in claim 1, wherein the specific part comprises a slotted-head screw, a Philips screw, a square-head screw, a torx screw, a hex-head screw, a square-head bolt, a torx bolt, a hex bolt, a nail, and a rivet.

5. The hand tool as claimed in claim 1, wherein the surface of the embossment of the design comprises a non-slip decorative pattern.

6. The hand tool as claimed in claim 1, wherein the surface of the depression of the design comprises the non-slip decorative pattern.

7. The hand tool as claimed in claim 1, wherein the irregular shape of the settled and/or covered on the protection layer comprises a columnar shape, a pyramidal shape, a spindle shape, a dumbbell-shape or the combination thereof.

8. The hand tool as claimed in claim 1, wherein the protection layer is settled and/or covered on the shaft, the at least one of the affecting portion, an end point, a protrusion, a dent, a turning point and a combination thereof.

* * * * *